United States Patent [19]

Latimer

[11] 4,319,782

[45] Mar. 16, 1982

[54] MEANS FOR CONTROLLING FEED OF PARTICULATE MATERIAL INTO AIRLIFT PIPE

[75] Inventor: John P. Latimer, Newport News, Va.

[73] Assignee: Deepsea Ventures, Inc., Gloucester Point, Va.

[21] Appl. No.: 157,292

[22] Filed: Jun. 6, 1980

[51] Int. Cl.[3] ..... E02F 3/94

[52] U.S. Cl. ..... 299/1; 37/DIG. 1; 37/DIG. 8; 37/57; 406/3; 406/28; 299/8

[58] Field of Search ..... 299/1, 8, 9; 406/3, 406/28, 31, 19; 37/DIG. 1, 57, 62, 63, DIG. 8

[56] References Cited

U.S. PATENT DOCUMENTS

| | | | |
|---|---|---|---|
| 3,179,471 | 4/1965 | Savage | 406/31 X |
| 3,621,593 | 11/1971 | Hickey | 406/19 |
| 3,971,593 | 7/1976 | Porte et al. | 299/8 |
| 3,975,054 | 8/1976 | Brockett et al. | 37/DIG. 8 |
| 4,232,903 | 11/1980 | Welling et al. | 299/8 |

FOREIGN PATENT DOCUMENTS

| | | | |
|---|---|---|---|
| 3384 | 8/1979 | European Pat. Off. | 299/9 |

*Primary Examiner*—Ernest R. Purser
*Attorney, Agent, or Firm*—Barry G. Magidoff

[57] ABSTRACT

To limit the amount of solid particulate matter fed into an airlift pipeline from, especially, a suction nozzle device, the density of the suspension passing from the suction nozzle to the airlift system is measured. If the measured density is above a predetermined value, a proportion of the suspended solid material is removed prior to passing into the airlift pipe.

The density of the moving suspension is determined by a radiation-type densitometer located upstream from the airlift pipe. The density can also be directly measured by a balance beam or weighing arrangement connected to a pivotable length of pipe. Where fine particles are present that are not to be considered in the densitometer measurement, a differential measurement can be obtained by a second measurement of the density of liquid from which the large particles have been screened.

21 Claims, 14 Drawing Figures

17
122
120
126
123
125
323
223
430
230

MEANS FOR CONTROLLING FEED OF PARTICULATE MATERIAL INTO AIRLIFT PIPE

This invention is directed to means for controlling the feed of suspended particles into an airlift pipe. The invention is especially adapted for use in the mining of ocean floor nodule ores.

With the recognition that terrestrial sources for raw materials, especially ores, are being swiftly depleted, effort has been made to obtain these valuable industrial raw materials from other sources, most especially the abyssal depths of the oceans. Such sources are generally to be found at depths of between 10,000 and 18,000 feet, requiring extremely deep water dredging means. The most valuable ores found to date are known as ocean floor nodule ores, or manganese nodules. These materials are often found as relatively small particulate forms, including fist-sized rocks or smaller pebbles, or even as grains of sand.

A great deal of engineering effort has been undertaken to date to secure these ores and bring them to the surface for further processing.

The deposits of these valuable metal ores are often lying on the surface of the soft sea floors, in the form of fist-sized rocks, often partially immersed within a sediment layer on the ocean floor. The exact size of the ore pieces vary greatly, from relatively small pebbles or even sand-like grains, up to large rocks or even boulders. The smaller of such ore pieces can be directly secured by one form of mining machine designed to date, and that is the suction head dredge vehicle. Such a suction-type of dredging vehicle literally sucks the ore pieces, much in the way of a vacuum cleaner, into the mining system, and eventually transfers the thus collected particles, via elevator means, from the dredge vehicle to a surface vessel. The type of elevator means especially useful in combination with a suction type nozzle dredging means includes the so-called airlift means.

A common problem found with such airlift systems, is the maintenance of a substantially constant proportion of particulate material within the airlift pipe, so as to enable the airlift system to operate most efficiently at a substantially continuous rate. Such airlift systems are generally designed to be operated to lift ore particles at a specified weight rate; the conduit dimensions and pumping devices utilized are sized so as to operate most efficiently when lifting ore particles at a given rate, generally optimized within a narrow range.

Unfortunately, the ores are not always uniformly dispersed along the surface of the ocean floor, and thus in many cases the systems have had to operate outside of the optimal lifting rate range. Although operating at too low a rate lifting is inefficient, the intake of an excessive amount of particles can result in an overloading of the airlift pipe system, eventually leading to reversing of flow and, ultimately, plugging of the pipe. To relieve any such overloading and prevent plugging, the use of relief valves have been proposed, such as those disclosed in U.S. Pat. Nos. 3,307,576 or 3,318,327.

In accordance with the present invention, means are provided to control the flow of ore material into an airlift pipe system, or other vertical elevator system, in order to limit the variation in rate of flow of such ore particles through the lift system. The present invention provides most broadly for an improvement in a dredge assembly comprising: an ore particle collection means, designed and adapted to remove solid ore particles from the ocean floor surface; fluid flow conduit means operatively connected at one end to the collection means and at a second end to a vertical airlift pipe system and designed to convey a suspension of ore particles-in-water between the collection means and a vertical airlift pipe system. The improvement comprises density-measuring means operatively connected to the conduit means and capable of signaling a change in density of suspended solids relative to a predetermined value; and ore-bypass means operatively connected to the dredge assembly between the collection means and the second end of the conduit means and in signal-responsive connection with the measuring means, whereby a change in density of suspended solids to above a predetermined value causes rejection of ore particles before reaching the airlift pipe.

In one embodiment, the ore collection means is a nozzle, and the dredge assembly further comprises first fluid flow conduit means in fluid flow connection to the nozzle; transient reservoir means, in fluid connection with the first conduit means; removal means for passing a suspension of ore particles and water from the reservoir means; a second fluid flow conduit means connected at one end to said removal means and at a second end designed to be connected to an airlift pipe; density-measuring means operatively connected to the second conduit means so as to determine the density of suspended solids in the fluid within the second conduit means; and the bypass means is operatively connected for rejecting ore particles from the reservoir.

In yet another, preferred embodiment, the dredge assembly comprises a nozzle having a nozzle opening for collecting solid ore particles from the ocean floor, and fluid flow conduit means designed to make a fluid flow connection between the nozzle opening and a vertical airlift pipe, and screening means located within the conduit means for separating ore particles from a portion of the water in which they have been suspended and carried to the conduit from the nozzle. The separated water portion passes to a bypass conduit. The density measuring means is located between the nozzle opening and the screening means.

In a further improvement, a second density measuring means is operatively connected to the bypass conduit to measure the density of the solids suspended in the separated water. In this manner, the effect of suspended fines, such as silt, etc. can be eliminated.

The rate at which the ore solids are moved from the dredge vehicle to the surface vessel is actually determined by the ratio of the ore particles to water in the vertical pipe and the water velocity. The density of the suspension increases with increasing proportion of solid particles, and decreases with decreasing proportion of solid particles. Thus, the present invention effectively provides means to vary the proportion of liquid-to-solids in the vertical pipe lift system by removing solids from the feed to the vertical pipe on command. The ore solids removed can be stored on board the dredge vehicle until such time as the dredge vehicle reaches an area of the ocean floor where the ore particles are less densely available. Alternatively, and in the much simpler embodiment shown in the drawings, the ore solids can be merely jettisoned from the system back to the ocean floor.

The invention defined herein is exemplified by the embodiments described hereinbelow and illustrated in the accompanying drawings. The preferred embodiments are presented herein to provide a more clear understanding of the invention and its advantages, and not to limit the scope of the invention.

Figure 1:
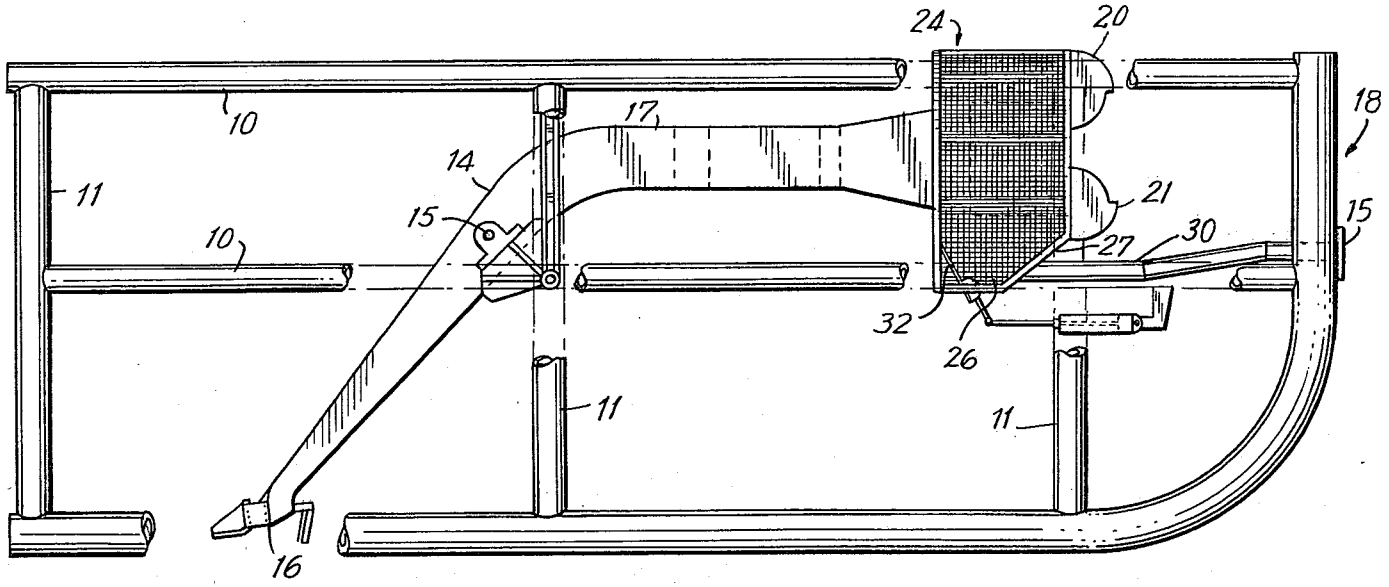
FIG. 1 is a side elevation view showing a suction nozzle-type dredge vehicle including the present invention.

In FIG. 1, the dredge vehicle, generally indicated by the numeral 8, is of the sled or skid runner type. The dredge vehicle 8 is, in this embodiment, intended to be towed from a surface vessel, the connecting link including, preferably, an airlift pipe.

The dredge vehicle 8 is of a generally skeletal structure, formed of intersecting horizontal and vertical bars 10, 11, respectively. A suction-type dredge nozzle, generally indicated by the numeral 14, is shown as being pivotally supported from the dredge vehicle 8 about a horizontal axis 15. The nozzle opening 16, at the lower end of the nozzle 14, is located towards the rear of the dredge vehicle; the nozzle 14 slopes upwardly and forwardly therefrom, to a fluid flow connection at the pivot 15, with a forwardly extending duct 17.

A mixed flow, propeller-type suction pump, is in fluid flow connection on its suction side with the forwardmost portion of the duct 17. The pump discharges to a hopper basket, generally indicated by the numeral 24 through two halves 20, 21 of a split toroid reversing diffuser discharge fitting. The basket 24 is also rigidly secured to the dredge vehicle frame 8 and is in fluid flow connection with an airlift inlet pipe 30 extending towards the forward end of the dredge vehicle 8.

Figure 2:
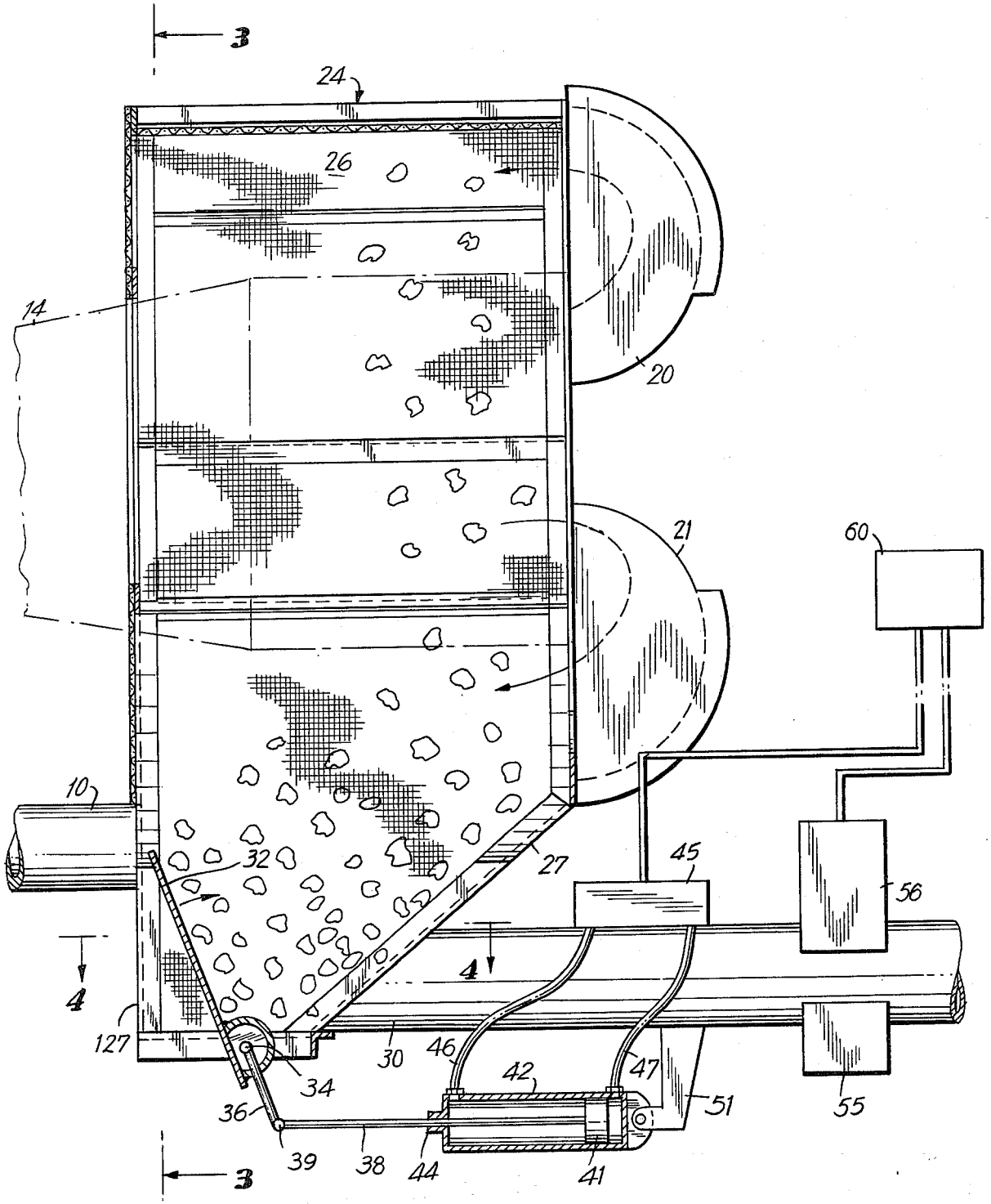
FIG. 2 is a partial cross-section of the forward part of the dredge vehicle of FIG. 1, enlarged, to show the control system in accordance with the present invention in greater detail.
Figure 3:
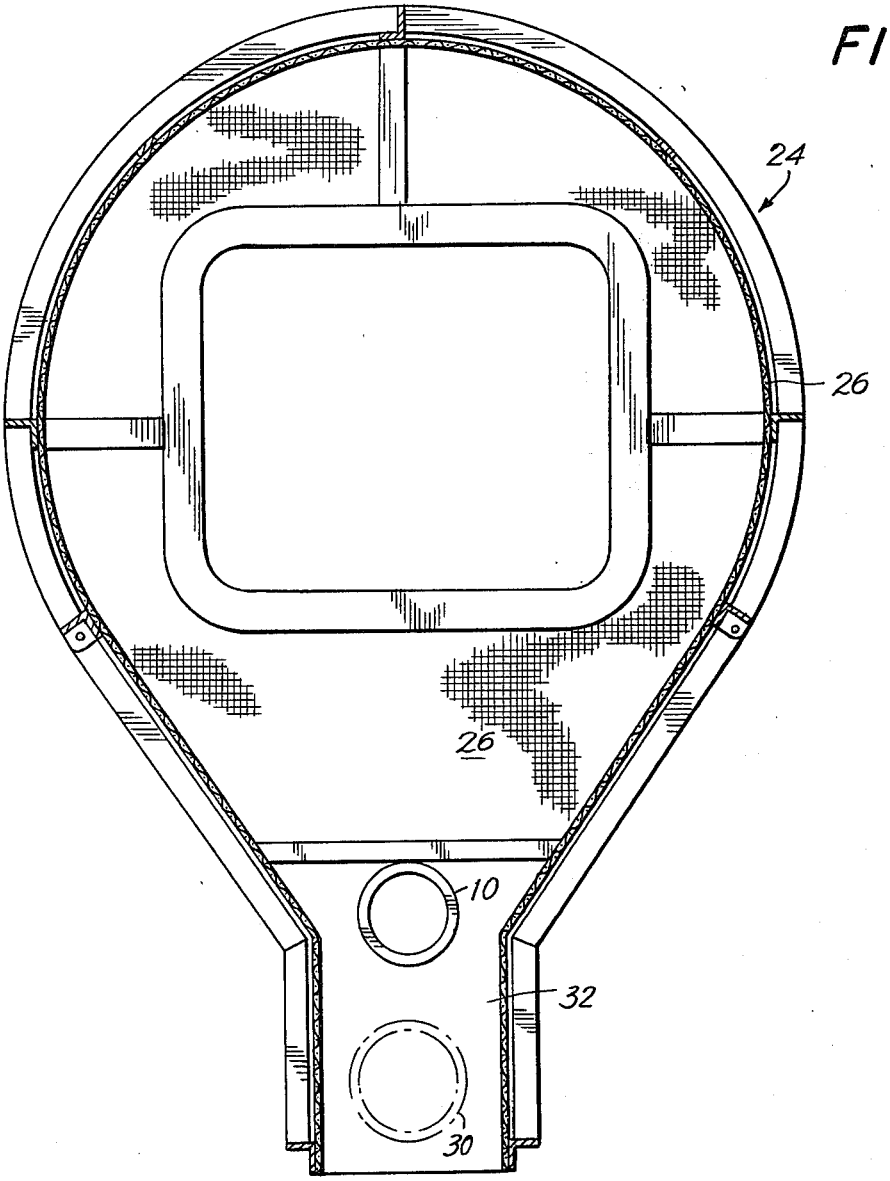
FIG. 3 is a cross-section view taken along lines 3—3 of FIG. 2.
Figure 4:
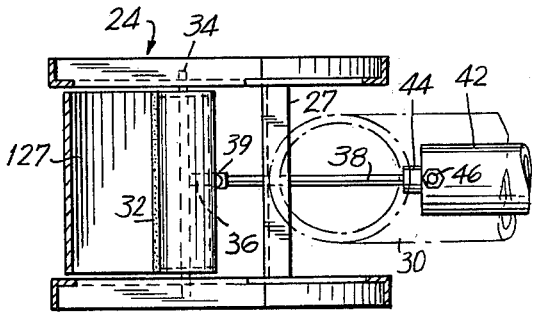
FIG. 4 is a cross-section view taken along line 4—4 of FIG. 2.
Figure 5:
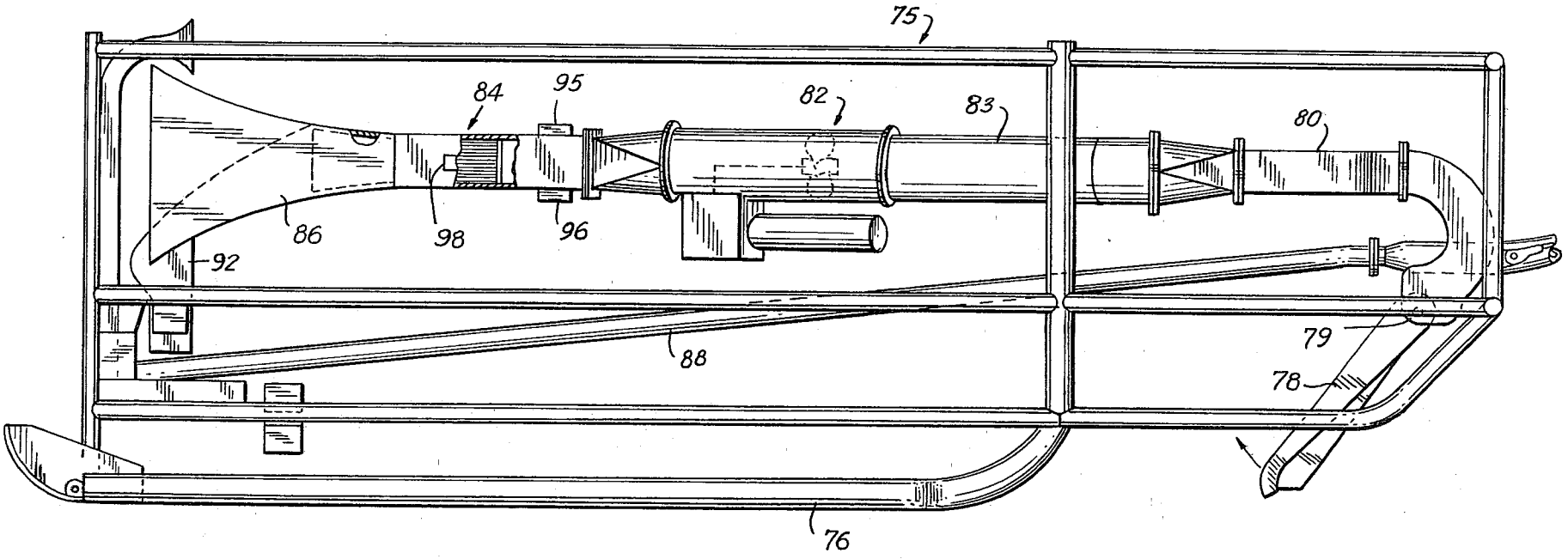
FIG. 5 is a side elevation view of a second embodiment of a suction nozzle-type dredge vehicle including the present invention.
Figure 8:
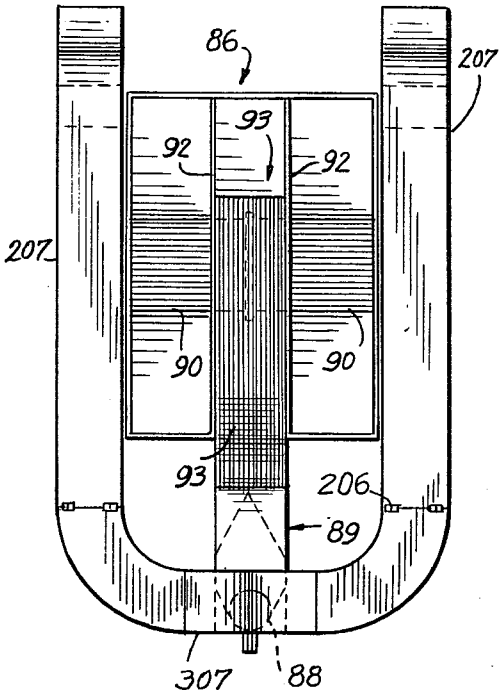
FIG. 8 is a rear elevation view of a portion of the vehicle of FIG. 5 along lines 8—8 of FIG. 7.
Figure 6:
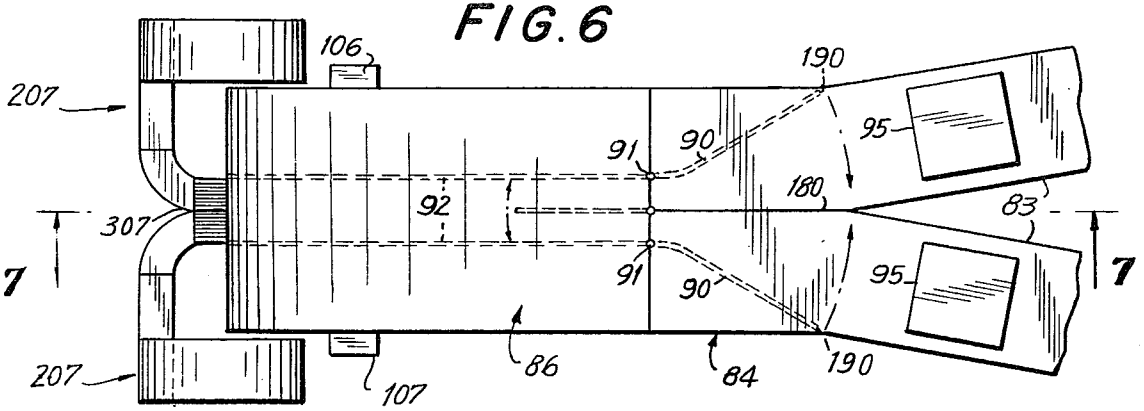
FIG. 6 is a partial, enlarged plan view of a rearmost portion of the dredge vehicle of FIG. 5.
Figure 7:
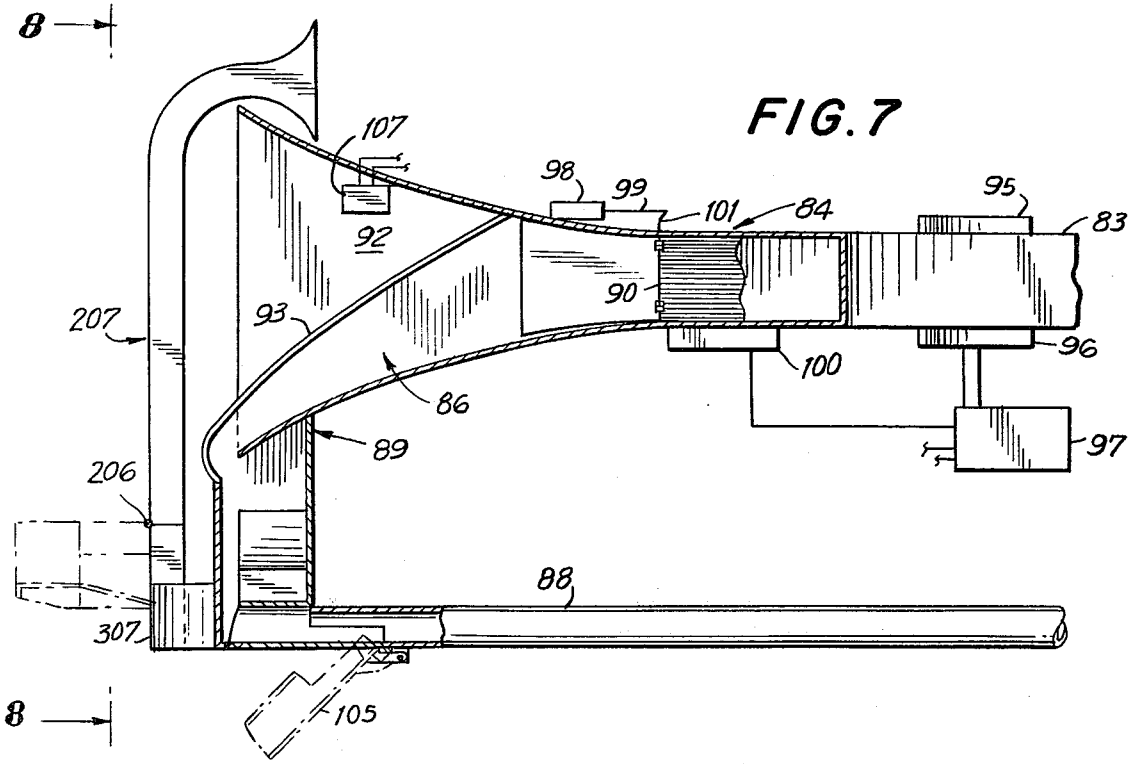
FIG. 7 is a section view taken along lines 7—7 of FIG. 6.

The basket 24 is formed from generally perforate, e.g., mesh, sidewalls 26. The upper portion of the hopper basket 24 is relatively wider, to accommodate the exhaust from the pump volutes 20, 21. Within the narrower lower portion of the basket 24 an angled plate 27 facing downwardly and forwardly defines an exhaust opening from the basket 24, opening into pipe 30. The lower, rear closure 32 of the basket 24 is pivotally mounted to the basket 24, so as to swing from a closed position, facing rearwardly and downwardly, as shown in FIG. 1, forwardly to an open position, as shown by the arrow in FIG. 2.

The rear closure plate 32 is fixedly mounted upon an axis pin 34, which is in turn rotatably mounted upon the frame of the hopper basket 24, at the bottom thereof. A lever arm 36 is rigidly secured to the lower portion of the closure plate 32, and the arm 36 is in turn pivotally secured to an hydraulic piston rod 38 via elbow joint 39. The piston rod 38 is in turn secured to the piston 41 which is slidably mounted within the hydraulic cylinder 42, passing through bushing 44 at the rear of the cylinder 42 so as to maintain a fluid tight seal. The two ends of the cylinder 42 are in fluid pressure connection to an hydraulic pump 45, mounted upon conduit 30, via hydraulic pressure lines 46, 47, respectively. The cylinder 42 is mounted upon the conduit 30 via angle iron 51.

Control over the hydraulic cylinder, and thus movement of the pivotable surface 32, is achieved via a sensing mechanism for measuring the solids density of the suspension passing through the pipe 30, i.e., on the way to the vertical airlift pipe, and thus determining the concentration of ore solids in the fluid. Although substantially any suitable type of means for sensing this value can be utilized, a preferred system is the gamma-radiation densitometer depicted in the drawings. A gamma-ray source 55 is attached to the pipe 30, downstream from the hopper basket 24. An electronic gamma radiation counter and signal source 56, is secured to the pipe 30 diametrically opposite the radiation source 55. Generally, the quantity of gamma radiation reaching the counter 56, assuming a substantially constant rate of radiation from source 55, is directly proportional to the density of the fluid within pipe 30, and thus to the proportion of solids therein.

The counter 56 is electronically connected to a control switch 60, also secured to the dredge vehicle 8, which is in turn operatively connected to the hydraulic pressure source, i.e., pump 45. The control switch 60 is designed to activate the pump 45 when a signal is received from the counter 56.

In operation, the dredge vehicle 8 is usually towed from a surface vessel along an area of the ocean floor known to have a significant proportion of nodule ore particles spread across the ocean floor. The nodule ore particles on the surface are sucked into the nozzle opening 16 as the dredge vehicle means along the ocean floor. The water and ore particles pass upwardly through the nozzle 14 and forwardly through the pump discharge reversing diffuser 20, 21 and into the upper portion of basket hopper 24. The particles then fall downwardly through the hopper 24 to the inlet to pipe 30, leading to the airlift pipe 15. The water and ore particles pass into the pipe 30, and then to the airlift pipe 15 leading to the surface vessel.

The densitometer 55, 56 is in continuous operation, measuring the density of the suspension passing through pipe 30 directly between the source 55 and counter 56. When the radiation counter 56 indicates an amount of radiation below a certain predetermined level, indicating an increase in density of the suspension above a predetermined value, a signal activates the switch 60 to start the operation of the hydraulic fluid pump 45, so as to increase the pressure through line 47, thus forcing the piston 41 and piston rod 38 to move rearwardly. This rearward motion in turn causes a pivoting of the arm 36 and of the plate 32, opening the lower portion of the hopper basket 24 and permitting the ore particles to pass outwardly to the rear of the hopper; this decreases the amount of ore solids passing into the airlift from pipe 30.

The resultant decrease in the amount of ore solids in the pipe 30, causes an increase in the radiation measured by counter 56; when the radiation increases to above a predetermined level, as the solids concentration drops, the switch 60 is triggered activating pump 45 in the reverse direction, causing a decrease in pressure in line 47 and an increase in line 46, thereby moving the piston 41 forwardly and pivoting the plate 32 rearwardly, thus closing off the hopper basket 24, and again increasing the proportion of ore solids passing into pipe 30 from the basket 24.

The nodule feed control means of this invention can be used to prevent overloading of the airlift system in the event of a sudden, unexpected increase in the density of ore particles on the ocean floor. Generally, the quantity of ore particles swept up by the dredge per unit time equals the density of particles on the ocean floor, per unit area, multiplied by the area swept by the dredge nozzle openings and the velocity of the dredge. When there is a sudden increase in ore density, there is a corresponding increase in particles swept up by the dredge. The feed control means of this invention can be used to prevent clogging of the lift pipe until the velocity of the dredge can be reduced in an amount corresponding to the increase in surface density, e.g., by slowing the surface vessel towing the dredge.

Referring to the second, preferred embodiment shown in FIGS. 5–8, a sled runner-type dredge vehicle, generally indicated by the numeral 75, and which is also intended to be towed from a surface vessel, is shown and includes four nozzles 78 pivotably suspended from the forward portion of the vehicle 75. This dredge vehicle is also of the generally skeletal structure, formed of intersecting horizontal and vertical members. The nozzle opening is at the lower end of the nozzle 78, and again faces downwardly and forwardly. Each nozzle 78 pivots about a generally horizontal nozzle pivot axis 79 and is in fluid flow connection with a duct 80, which is supported on the dredge vehicle 75. A pump 82 is supported within a combined duct 83 such that a fluid mixture passing from two nozzles 78 into and through two ducts 80 passes in line through the pump 82 and its impeller, not shown in detail. The ducts 83 from each of two pumps come together in a manifold section, generally indicated by the numeral 84. The upstream portion of the manifold section 84 includes a pair of screens or grates 90 which serve to separate the larger solid particles suspended within a liquid in the ducts 83 from at least a portion of the liquid. The screens 90 each are in turn pivotally connected, about a pivot point 91, to internal conduit walls 92 within a diffuser conduit section, generally indicated by the numeral 86. The central portion (defined by the internal conduit walls 92 and a transverse rear wall 93) of the diffuser conduit section 86 is in turn in fluid flow connection to a feed section 89 leading to the airlift suction pipe 88. Each of the two screens 90, pivotally supported on the internal walls 92, are also pivotally connected by pins 101 to a piston rod 99, moving within an hydraulic cylinder 98.

The screens or grates can be formed of a vertically arrayed series of relatively slender rods separated by a distance equal to the minimum desired ore particle size. The free, upstream ends of the rods are preferably tipped with a highly resilient material, such as rubber, to reduce breakage of ore particles striking the ends.

Control over the hydraulic cylinder 98, and thus movement of the pivoting nodule screens 90 is achieved via a sensing mechanism for measuring the solids density of the suspension passing through the conduits 83, in the same fashion as described above for the first embodiment. A gamma-radiation source 95, on the top wall of each of the ducts 83 is attached directly opposite a gamma-radiation counter 96 secured to the lower portion of each of the ducts 83. The output from each of the counters 96 is connected to a signal source 97 which acts to average the radiation count, and is in turn operatively connected to send a signal to activate the hydraulic pump 100, in response to a change in radiation count, and thus to power the hydraulic cylinder 98 to move the pivoting screen 90 in the direction of the arrows. An additional feature of the preferred embodiment is that signal source 97 is adjustable from the surface vessel, either through an electrical circuit or control channel, to limit the maximum nodule feed rate to a desired value.

In a most preferred embodiment of this invention, there is further provided a differential gamma-radiation source 106 and differential gamma-radiation counter 107, attached on opposing sides of the diffuser zone 86, in the portion that is substantially free from the ore particles to be collected.

Figure 10:
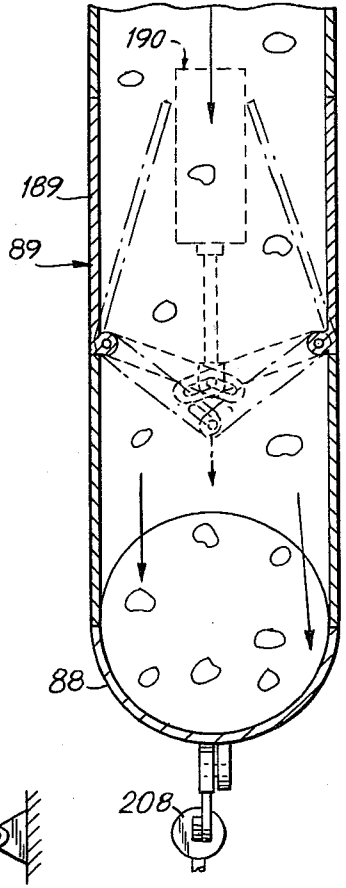
FIG. 10 is a section view along lines 10—10 of FIG. 9.
Figure 9:
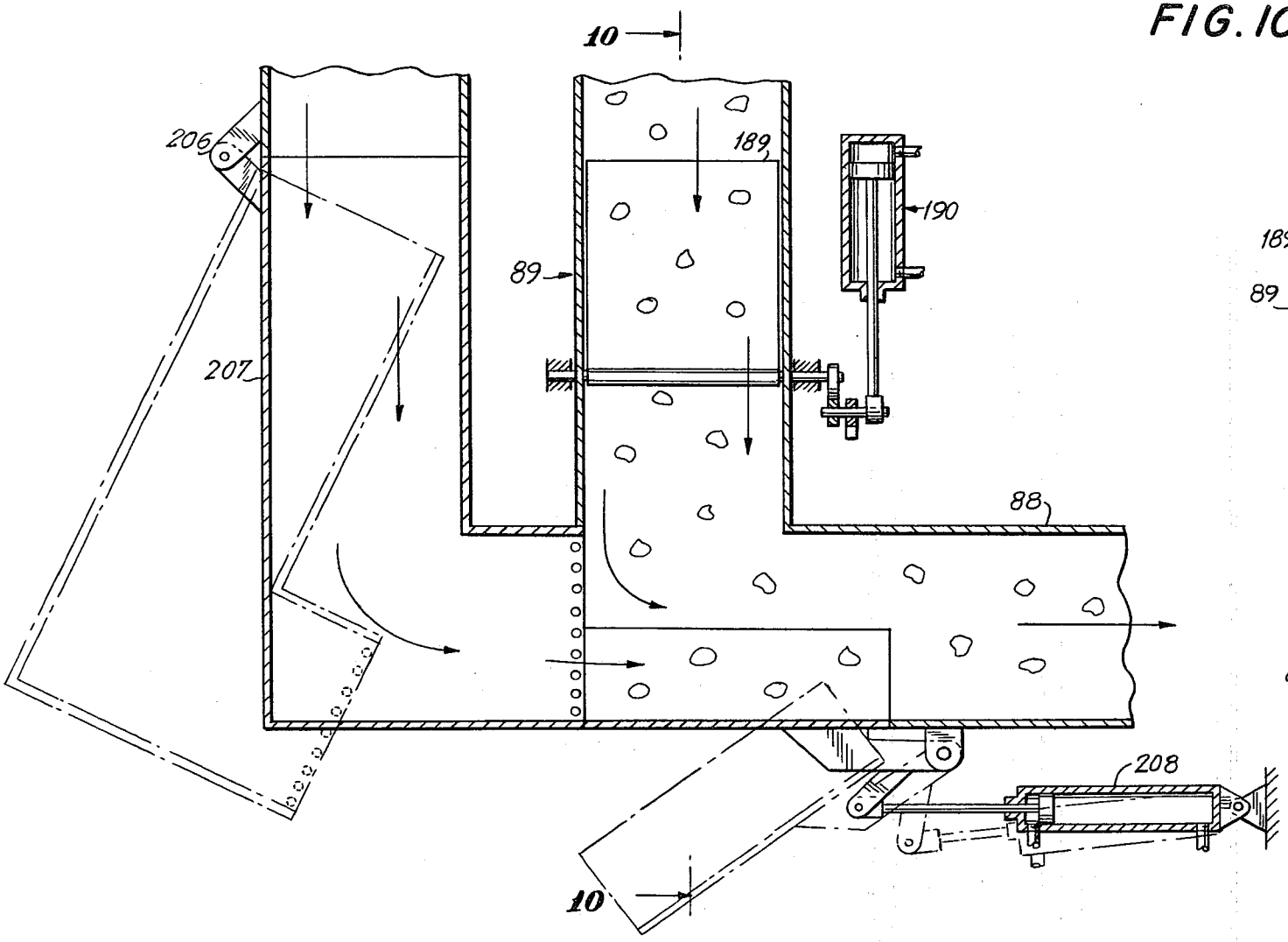
FIG. 9 is a magnified view of the rear lower portion of the system showing an alternative injection control means.

As an optional and further means of controlling the feed of nodule ore particles to the airlift system, as shown in FIGS. 9 and 10, at least a portion of the side walls 189, of the feed section 89, are pivotably movable inwardly, to permit a part of all of the nodules existing from the central diffuser portion 92 to be discharged out of the dredge system before reaching the suction pipe 88. The pivoting wall portions 189 are operated by a hydraulic cylinder 190, activated in response to a signal from the signal source 97.

The rear lower corner 307 of the clear water duct manifold 207 is hingedly connected to the dredge system about hinge 206, and a dump door 105 is provided at the upstream end of the airlift suction pipe 88, where the pipe 88 is joined to the intermediate section 89, through which the ore particles pass in transit to the suction pipe 88. The dump door 105 and lower duct portion 307 are movable by a hydraulic cylinder 208 and one not shown, respectively. Such dump door 105 when opened concurrently with the hinged lower portion of clear water duct 307 serves the additional purposes of clearing any jam that may occur near the entrance to the suction pipe 88.

Figure 11:
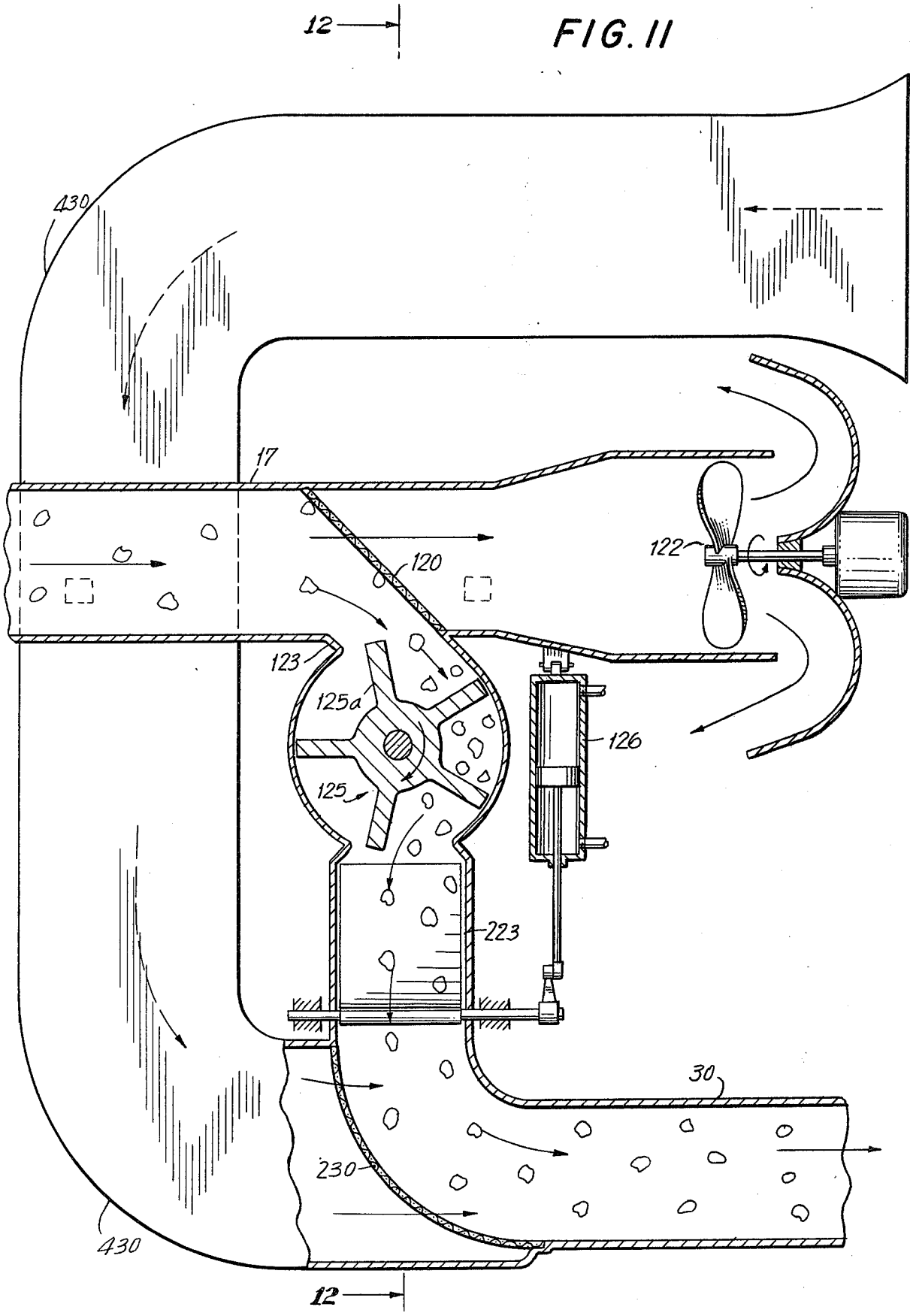
FIG. 11 is a partial diagrammatic side view of an alternative embodiement of FIG. 1.
Figure 12:
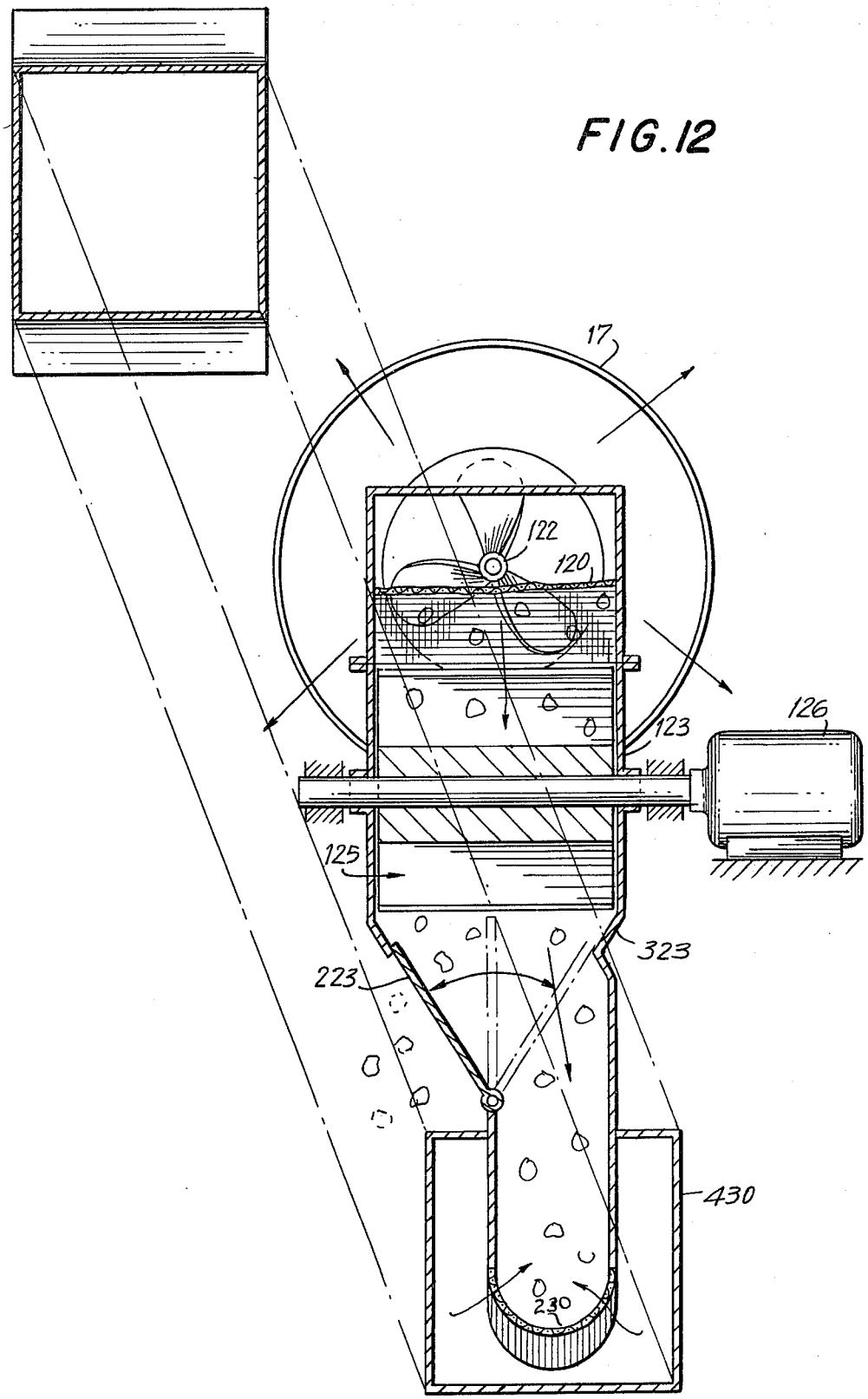
FIG. 12 is a cross-sectional view along lines 12—12 of FIG. 11.
Figure 13:
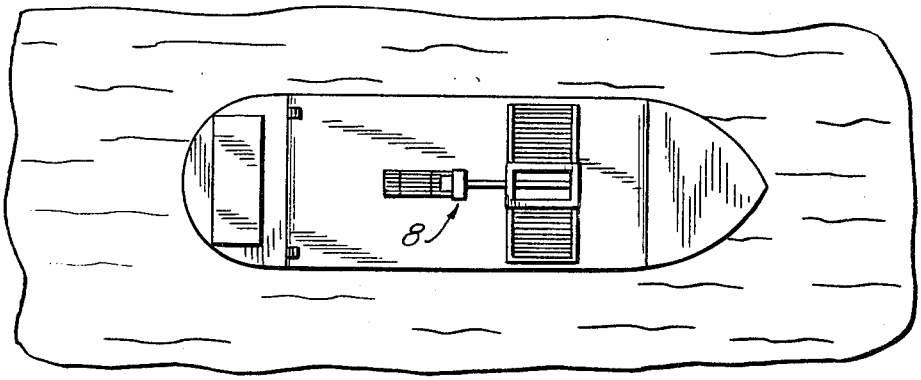
FIG. 13 is an elevation view of a surface vessel towing a dredge vehicle along the ocean floor.
Figure 14:
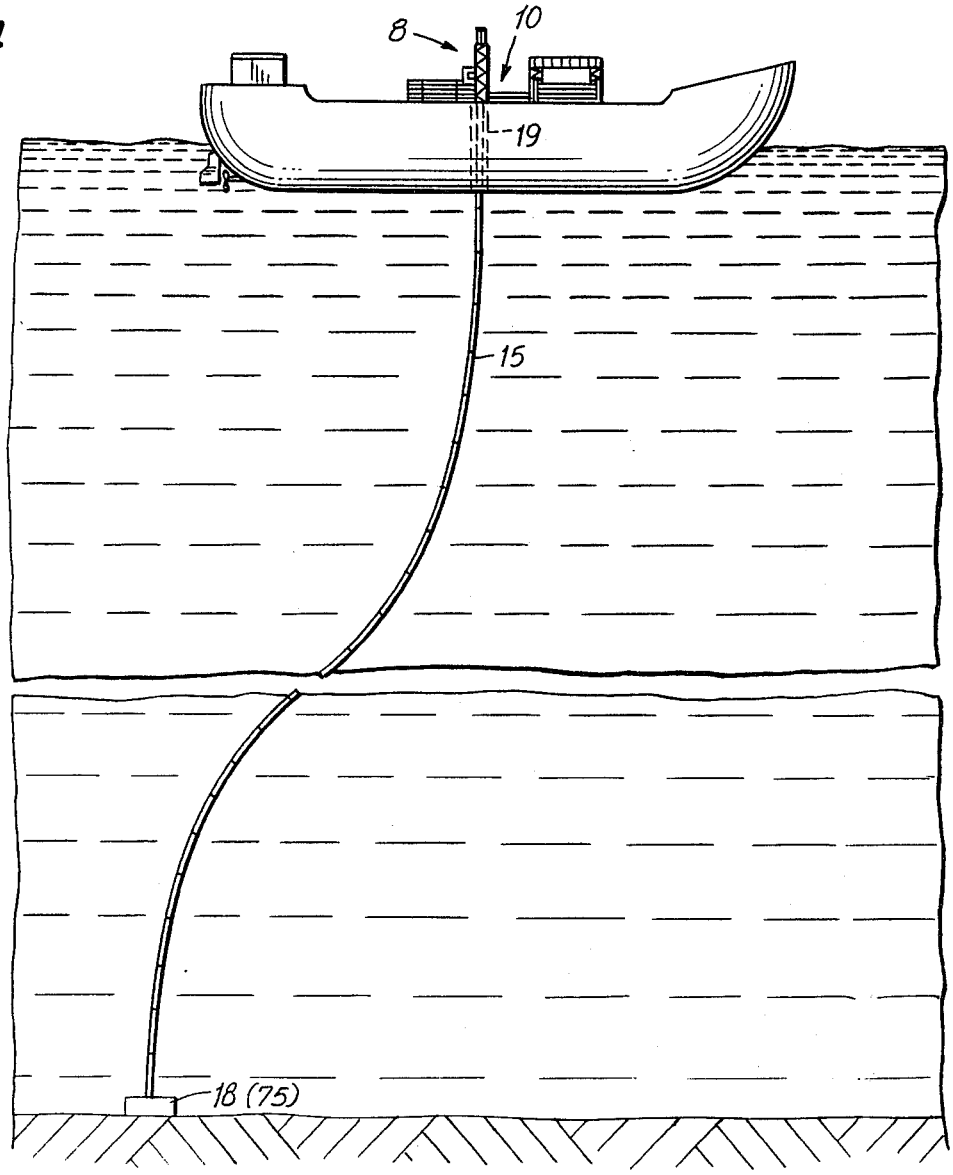

FIGS. 11 and 12 diagram an alternative nodule injection control device for the dredge of FIG. 1. In this embodiment the nodules are screened before entering the impeller chamber by the obliquely extending screen 120 in the duct 17, located between the pump impeller 122 and a nodule outlet duct 123. A flow directing rotor gate 125, formed by molded rubber or other elastomeric or flexible polymeric material is rotatably supported within the outlet duct 123. Preferably, the radially outward-most portions of the lobes **125*a* contact the duct wall 123 to provide at least a partial seal adequate to minimize water leakage towards the duct 17. Also, the preferably flexible nature of the lobes 125*a* serves to avoid pinning of nodules between the rotor 125 and the duct wall 123. The rotor gate 125 is operatively connected to, and rotated by, a hydraulic motor 126**.

Below the rotor gate 125, an injection control gate 223 forms a side wall of a lower chamber 323 and is connected pivotably movably inwardly between a closed position, shown in solid line in FIG. 12, and open position to dump some or all of the nodules, as shown in phantom lines in FIG. 12.

The airlift inlet pipe 30 connects the lower chamber 323 below the control gate 223. A clear water suction pipe 430, extending downwardly from above the dredge chassis connects into the inlet pipe 30 through a nodule screen 230, formed to prevent any backflow of nodules into the clear duct 430.

The nodules drop from the rotor gate 125 into the lower chamber 323 by gravity, falling through water in the lower chamber 323 towards the airlift inlet pipe 30. The lower chamber 323 thereby acts as a transient reservoir for the nodules, which are then pulled into the airlift inlet pipe 30 and entrained in clear water from the clear water duct 430. During operation of the pump 122, the lobes of the rotor 125 serve to remove nodules that cannot pass through the screen 120, and thus accumulate at the top of duct 123, adjacent the screen 120. The lobes 125*a* also serve to minimize water backflow towards the main duct 17, from the exit duct 123, thus maintaining the efficiency of the pumped flow through the main duct 17 from the nozzle. The water tends to flow towards the lower pressure in the main duct 17, which is at a pressure below ambient, e.g., about 4 psi in this embodiment, unless special equipment is utilized.

In the operation of the most preferred embodiment of FIGS. 5 through 8, the four dredge nozzles 78 pick up ore particles from the ocean floor as the dredge vehicle 75 is towed from a surface vessel. The water and ore particles picked up by each nozzle pass through the respective ducts 80, 83 connected to that nozzle 78 and to the manifold section 84, where a portion at least of the water passes outwardly through the screens 90, while the ore particles which are of the size larger than the separation between the screen members pass between the screens 90 and into a central conduit defined by the internal conduit walls 92 and 93. The nodules and water flow through the diffuser zone 86, as bounded by the internal conduit walls 92, 93, into the intermediate conduit 89 and then into the suction pipe 88.

As before, the densitometer 95, 96, is in continuous operation, measuring the density of the suspension passing through the ducts 83. Upon a decrease in the amount of radiation measured by the counters 96, the switch 97 activates the hydraulic pump 100, causing inward movement of the piston rods 99 towards the central duct wall 180. As the upstream ends 190 of the screens 90 move away from the outer walls of the ducts 80, a portion of the ore particles can bypass the central conduit 92 and be discharged back into the ocean, through the diffuser zone 86. The extent to which the screens 90 are pivoted centrally, or towards each other, determines the proportion of each duct 83 opened to exhausting the ore particles, and thus, as before, the extent of the decrease of the flow of ore particles into the airlift suction pipe 88.

To further increase the precision of the ore particle measuring means, the differential gamma-radiation source 106 and counter 107 can be utilized to compensate for the amount of silt or other fine particles suspended in the water within the ducts 83, but which are exhausted through the screens 90 even when they are fully closed. By means of a differential measuring means, well known in this art, the density of the liquid being exhausted through the outer portions of the diffuser section 86 (outside of the central conduit defined by the inner walls 92, 93), as measured by the densitometer 106, 107, can be subtracted from the density of the suspension in the ducts 83, to obtain the true density based upon the amount of suspended ore particles which do not pass through the screens 90, and, therefore, are carried into the airlift suction pipe 88, and ultimately into the airlift vertical pipe system. Because of the time required for the suspension liquid to pass from the densitometer 95, 96 to the diffuser section 86, a signal delay can be incorporated into the circuitry, such that the differential density measured is based upon the same liquid present in duct 83 as is measured in the diffuser zone 86.

An optional means of controlling the flow of ore particles into the suction pipe 88 includes the use of the dump door 105 and pivoting clear water manifold portion 106. Although the dump door 105 is of greatest use for clearing a jam of ore particles that may have been created within the airlift system, it can also be utilized as an imprecise form of nodule feed control, in the event of failure of the more sensitive and sophisticated systems upstream.

In addition to providing for by-passing of the ore particles, as explained above for the two preferred embodiments illustrated, the decrease in nodule flow can be obtained by decreasing the amount of ore collected, e.g., by the nozzles. When a plurality of nozzles are operated from a single dredge vehicle, one or more of the nozzles can be made inoperative, e.g., by shutting down the pump connected to that nozzle, or by pivoting the nozzle rearwardly and upwardly above the ocean floor, beyond the optimum suction range of the nozzle.

It has generally been found that the optimum proportion of ore particles within the airlift pipe, and thus also within the airlift feed pipe 30, is not greater than about 30%, and even more preferably is within the range of from about 15 to 25%.

In the above embodiment, the preferred density measuring means and operating means are depicted. This invention can be carried out with alternative density measuring means, including for example means for weighing a length of pipe carrying the suspended ore particles. Similarly substitutes for the hydraulic screen operating means include electric motors, electrical linear activators and hydraulic motors.

The patentable embodiments of the invention claimed are as follows:

1. A dredge assembly comprising: ore particle collection means designed to remove solid ore particles from the ocean floor surface; fluid flow conduit means connected at one end to the collection means and designed to be connected at a second end to a vertical airlift pipe system and thus to convey a suspension of ore particles-in-water between the collection means and such vertical airlift pipe system; density measuring means operatively connected to the conduit means and capable of signaling a change in concentration of suspended solids relative to a predetermined value; and ore particle-bypass means operatively connected to the dredge assembly between the collection means and the second end of the conduit means, in signal-responsive connection with the measuring means and designed to reject suspended ore particles before reaching the second end of the conduit means, whereby a change in density of suspended solids to above a predetermined value causes rejection of ore particles before reaching the airlift pipe.

2. The dredge assembly of claim 1 wherein the collection means comprises a suction nozzle.

3. The dredge assembly of claim 2 comprising in addition pumping means operatively connected to accelerate fluid flow into and through the nozzle and conduit means.

4. The dredge assembly of claim 1 wherein the density measuring means comprises a radiation source designed to direct radiation through the conduit and a radiation measuring means designed to measure the amount of radiation passing through the conduit means, a change in radiation measured varying inversely with a change in density of the suspension within the conduit means.

5. The dredge assembly of claim 1 wherein the bypass means comprises an exhaust aperture defined within the conduit means and a gate movably connected to the conduit means and movable between a position substantially closing off the aperture and a position in which the aperture is at least partially open to flow of suspended ore particles from within the conduit means.

6. The dredge assembly of claim 5 wherein the bypass means further comprises power means for moving the gate means between the two positions and operatively connected to the density measuring means so as to be responsive to a signal from the measuring means to the power means to activate movement of the gate means between the two positions.

7. The dredge assembly of claim 6 wherein the power means comprises an hydraulic cylinder and piston.

8. The dredge assembly of claim 1 comprising pumping means in fluid flow connection with the conduit means for drawing a mixed phase of water and ore particles through the conduit.

9. The dredge assembly of claim 8 comprising screening means for separating ore particles of above a predetermined size from at least a major portion of the water.

10. The dredge assembly of claim 9 wherein the screening means is located intermediate the pumping means and the vertical system, and further comprising control gate means to separate the flow of ore particles to the airlift system from the flow to the pumping means.

11. The dredge assembly of claim 10 wherein the control gate means provides chambering means to intermittently inject a quantum of ore particles to the second end of the conduit.

12. The dredge assembly of claim 10 or 11 wherein the bypass means is located intermediate the control gate means and the second end of the conduit.

13. The dredge assembly of claim 1 wherein the nozzle is pivotably connected to the assembly and wherein the nozzle can be raised vertically to above a level at which it can collect ore particles.

14. A dredge vehicle designed for movement along the ocean floor and a dredge assembly supported and operatively connected to the dredge vehicle for the collection of ocean floor nodule ores, the dredge assembly comprising:

suction nozzle means having a nozzle opening for the collection of nodule ores designed to be located adjacent the ocean floor when the dredge vehicle is moving therealong;

first fluid flow conduit means in fluid flow connection with the nozzle;

transient reservoir means, in fluid connection with the first conduit means;

removal means for passing a suspension of ore particles in water from the reservoir means;

a second fluid flow conduit means connected at one end to said removal means and at a second end designed to be connected to an airlift pipe system;

density-measuring means operatively connected to the second conduit means so as to determine the density of solids suspended in a fluid within the second conduit means and capable of signaling a change in such density relative to a predetermined value; and ore-bypass means operatively connected for rejecting solid particles from the transient reservoir, whereby a change in the density of suspended solids within the second conduit means causes rejection of ore particles before reaching the airlift pipe.

15. The dredge vehicle of claim 14 comprising in addition pumping means for accelerating fluid flow of a suspension of ore particles in water into and through the nozzle, first and second conduit means and the reservoir, the pumping means being in parallel fluid flow relationship to the second conduit means and in series fluid flow relationship with the nozzle and first conduit means;

and screening means for diverting solid ore particles of greater than a predetermined minimum size into the second conduit means and away from the pump means, whereby the larger solid particles collected by the nozzle pass toward the airlift system without passing through the pump.

16. A dredge vehicle for moving along the ocean floor and a dredge assembly supported on the dredge vehicle for collecting ore particles from the ocean floor, the dredge assembly comprising:

a nozzle supported on the dredge vehicle and having a nozzle opening designed to be located adjacent the ocean floor and to be capable of collecting a suspension of ore particles and water from the ocean floor;

pumping means in series fluid flow connection with the nozzle;

second conduit means in fluid flow connection at one end with the pumping means and at the second end designed to be connected to an airlift pipe system;

screening means within said second conduit for removing at least a portion of the water in which the ore particles are suspended, the screening means being movably secured within the second conduit means and movable from a first position in which only water and solid particles below a predetermined size can pass out of the second conduit and a position in which at least a portion of the larger then predetermined size solid particles can pass out together with the water, whereby the ore particles can be rejected prior to reaching the airlift pipe system.

17. A dredge vehicle for moving along the ocean floor and a dredge assembly for collecting ore particles from the ocean floor and delivering the ore particles to an airlift pipe system, the dredge assembly comprising:

a plurality of pumping means;

a plurality of nozzles for collecting solid ore particles from the ocean floor, at least two nozzles being in fluid flow connection with each pumping means, and so designed that a flow comprising a suspension of solid ore particles in water is accelerated into and through the nozzles and through the pumping means, each nozzle being in parallel fluid flow with the other nozzles and in series fluid flow with a pump;

a plurality of conduit means each conduit means in fluid flow connection at a first end with a pump and having a second end;

a manifold section in fluid flow connection with the second end of each of the conduit means, the manifold section comprising an airlift feed manifold portion and an exhaust manifold portion, both manifold portions being connected with each of the conduit means;

a screen means movably supported within each of the conduit means, the screen means permitting the passage of water and solid particles below a predetermined size but preventing the passage of solid particles above predetermined size, the screen means being movable between a first position directing ore particles above a predetermined size into the feed manifold portion and a second position wherein a portion of the larger solid ore particles can move into the exhaust manifold portion;

power means for moving the screen means;

density-measuring means operatively connected between the screen means and the nozzle and capable of signaling a change in density of suspended solids relative to a predetermined value, the power means being in signal responsive connection with the density-measuring means;

whereby a change in density of the suspended solids to above a predetermined value causes movement of the screen means to the second position.

18. The dredge assembly of claim 1, 3, 14, 15, or 17, wherein the density-measuring means comprises a radiation source and a radiation measuring means for measuring the amount of radiation passing through a constant volume of the flowing suspension.

19. The dredge assembly of claim 12, wherein the power means is an hydraulic system.

20. The dredge assembly of claim 15, 16 or 17, wherein the screen means comprise an array of relatively slender rods separated by a distance suitable for preventing the passage of solid particles of greater than a predetermined size.

21. The dredge assembly of claim 15, 16, or 17, wherein the screen means is pivotably movable.

* * * * *

UNITED STATES PATENT AND TRADEMARK OFFICE

CERTIFICATE OF CORRECTION

PATENT NO. : 4,319,782

DATED : March 16, 1982

INVENTOR(S) : JOHN P. LATIMER

It is certified that error appears in the above-identified patent and that said Letters Patent are hereby corrected as shown below:

Claim 19, line 1, correct "12" to --17--.

Signed and Sealed this

*Eighteenth* Day of *May 1982*

[SEAL]

*Attest:*

GERALD J. MOSSINGHOFF

*Attesting Officer*

*Commissioner of Patents and Trademarks*